US008875524B1

(12) United States Patent
Parnell

(10) Patent No.: US 8,875,524 B1
(45) Date of Patent: Nov. 4, 2014

(54) VEHICLE AIR CONDITIONING CHARGING HOSE ASSEMBLY AND METHOD

(75) Inventor: E. Lynn Parnell, Cornelius, NC (US)

(73) Assignee: FJC, Inc, Mount Mourne, NC (US)

( * ) Notice: Subject to any disclaimer, the term of this patent is extended or adjusted under 35 U.S.C. 154(b) by 1003 days.

(21) Appl. No.: 12/788,564

(22) Filed: May 27, 2010

(51) Int. Cl.
*F25B 45/00* (2006.01)

(52) U.S. Cl.
USPC ..... 62/77; 62/292

(58) Field of Classification Search
CPC ..... F25B 45/00; F25B 2345/00–2345/003; F25B 2345/006; F25B 2700/04
USPC ..... 62/77, 292; 251/148
See application file for complete search history.

(56) References Cited

U.S. PATENT DOCUMENTS

| | | | | | |
|---|---|---|---|---|---|
| 178,312 | A | * | 6/1876 | Leland | 251/148 |
| 715,425 | A | * | 12/1902 | Schamp | 137/798 |
| 3,645,496 | A | * | 2/1972 | Rawlins | 251/148 |
| 3,712,113 | A | | 1/1973 | Roscoe | 73/37 |
| 3,813,893 | A | | 6/1974 | Gemender et al. | 62/129 |
| 3,840,967 | A | * | 10/1974 | Olson | 29/221.6 |
| 3,916,641 | A | | 11/1975 | Mullins | 62/292 |
| 3,916,947 | A | * | 11/1975 | Holmes et al. | 137/544 |
| 3,935,713 | A | | 2/1976 | Olson | 62/77 |
| 3,976,110 | A | | 8/1976 | White | 141/346 |
| 4,319,459 | A | | 3/1982 | Hannett et al. | 62/77 |
| 4,884,410 | A | | 12/1989 | Bell et al. | 62/77 |
| 4,941,600 | A | | 7/1990 | Berriochoa et al. | 222/402.13 |
| 5,090,212 | A | | 2/1992 | Keltner et al. | 62/149 |
| 5,117,641 | A | | 6/1992 | Keltner | 62/85 |
| 5,168,720 | A | | 12/1992 | Keltner | 62/292 |
| 5,218,831 | A | | 6/1993 | Keltner | 62/77 |
| 5,220,810 | A | | 6/1993 | Keltner | 62/292 |
| 5,228,178 | A | * | 7/1993 | Stickley | 29/213.1 |
| 5,231,843 | A | | 8/1993 | Keltner | 62/77 |
| 5,247,803 | A | | 9/1993 | Adams et al. | 62/77 |
| 5,247,812 | A | | 9/1993 | Keltner | 62/475 |
| 5,295,367 | A | | 3/1994 | Keltner | 62/292 |
| 5,333,467 | A | | 8/1994 | Pearl, II et al. | 62/77 |
| 5,357,763 | A | * | 10/1994 | Vogel | 62/77 |
| 5,577,709 | A | * | 11/1996 | Gugala et al. | 251/315.14 |
| 5,673,722 | A | * | 10/1997 | Brass | 137/15.01 |
| 6,089,032 | A | | 7/2000 | Trachtenberg | 62/149 |
| 6,253,436 | B1 | * | 7/2001 | Barjesteh et al. | 29/213.1 |
| 6,360,554 | B1 | | 3/2002 | Trachtenberg | 62/292 |
| 6,385,986 | B1 | * | 5/2002 | Ferris et al. | 62/292 |
| 6,446,453 | B1 | | 9/2002 | Trachtenberg | 62/292 |

(Continued)

OTHER PUBLICATIONS

Definition of "Contiguous" from Merriam-Webster dictionary on the Britannica Academic Edition (online), retreived on Oct. 7, 2013 from http://www.britannica.com/bps/dictionary?query=contiguous.*

(Continued)

*Primary Examiner* — Cheryl J Tyler
*Assistant Examiner* — Orlando E Aviles Bosques
(74) *Attorney, Agent, or Firm* — Blake P. Hurt

(57) ABSTRACT

Air conditioning charging hose assembly and method allows for quick, safe and reliable air conditioning system testing and charging. The assembly includes a shut-off valve positioned proximate the supply fitting to allow a technician to quickly shut-off the refrigerant gas supply. The method also allows the technician to test the vehicle air conditioning system pressure when charging as the hose assembly is connected to the air conditioning system and when disconnected from the air conditioning system, allows the technician to determine the refrigerant gas canister pressure.

22 Claims, 3 Drawing Sheets

(56) References Cited

U.S. PATENT DOCUMENTS

| | | | | |
|---|---|---|---|---|
| 6,467,283 | B1 | 10/2002 | Trachtenberg | 62/149 |
| 6,609,385 | B1 | 8/2003 | Ferris et al. | 62/77 |
| 6,698,466 | B1 | 3/2004 | Cowan et al. | 141/67 |
| 6,722,141 | B2 | 4/2004 | Ferris et al. | 62/77 |
| 6,796,340 | B1 | 9/2004 | Ferris et al. | 141/67 |
| D511,307 | S | 11/2005 | Cowan et al. | D10/85 |
| 6,978,636 | B2 | 12/2005 | Motush et al. | 62/292 |
| 7,077,171 | B2 | 7/2006 | Carrubba | 141/1 |
| 7,107,781 | B2 | 9/2006 | Quest et al. | 62/292 |
| 7,260,943 | B2 | 8/2007 | Carrubba et al. | 62/77 |
| 7,275,383 | B2 | 10/2007 | Motush et al. | 62/292 |
| 7,559,245 | B2 * | 7/2009 | Knowles et al. | 73/714 |
| 8,302,411 | B2 * | 11/2012 | Martin | 62/149 |
| 2004/0168463 | A1 * | 9/2004 | Dudley | 62/292 |
| 2008/0190208 | A1 * | 8/2008 | Appler et al. | 73/714 |
| 2008/0216491 | A1 * | 9/2008 | Quest et al. | 62/77 |

OTHER PUBLICATIONS

One page printout showing "Measuring & Dispensing" charging hoses of Interdynamics from the 2005 Auto Air Conditioning Product Catalog.

* cited by examiner

VEHICLE AIR CONDITIONING CHARGING HOSE ASSEMBLY AND METHOD

FIELD OF THE INVENTION

The invention herein pertains to an assembly and method to quickly, efficiently test and charge air conditioning (AC) systems and particularly pertains to an assembly and method for vehicle air conditioning systems.

DESCRIPTION OF THE PRIOR ART AND OBJECTIVES OF THE INVENTION

Servicing air conditioning (AC) systems, especially for automobiles and other vehicles has become increasingly frequent, costly and competitive in recent years. Practically all U.S. cars and trucks are now equipped with air conditioning systems and it is recommended that these systems have at least annual testing and maintenance including charging to insure proper operation.

In order to provide proper and accurate testing and servicing of vehicle air conditioner systems, various types of tools and equipment have been manufactured to aid technicians, retail customers and others to insure proper servicing. In commercial shops and garages it is conventional to purchase refrigerant gas canisters which are threaded onto a hose assembly which is then connected to the vehicle air conditioning system for charging. The canister is punctured thereby releasing the refrigerant gas which flows generally through a hose and a gauge into the vehicle AC service port inlet. Typical hose assemblies are shown such as in U.S. Pat. Nos. 6,385,986 and 6,609,385 ('385) of Ferris et al., U.S. Pat. No. 6,978,636 of Motush et al. and U.S. Pat. No. 6,360,554 of Trachtenberg. These devices generally have a refrigerant gas canister fitting and a service port coupler whereas Motush et al. and Ferris et al. ('385) further include a gauge. Ferris et al. ('385) also utilizes a check valve downstream of the gauge. While these and other prior devices work well under normal circumstances additional features are desired to promote efficiency and save time, labor and to increase the safety of the servicing technician.

For these and other reasons the present invention was conceived and one of its objectives is to present an air conditioning charging hose assembly and method of use which includes a quick-turn shut-off valve positioned between the refrigerant supply fitting and the service port inlet coupler for quickly terminating the flow of refrigerant gas from the canister.

It is another objective of the present invention to provide a method for a service technician to more accurately test and charge a vehicle air conditioning system.

It is still another objective of the present invention to provide an air conditioning charging hose assembly having a gauge and shut-off valve which is conveniently located to allow the technician to pressure test both the refrigerant gas canister and the vehicle air conditioning system without having to always disassemble or disconnect the air conditioning charging hose assembly.

It is a further objective of the present invention to provide an air conditioning charging hose assembly which is relatively inexpensive to produce and which is safe and easy to use.

Various other objectives and advantages of the present invention will become apparent to those skilled in the art as a more detailed description is set forth below.

SUMMARY OF THE INVENTION

The aforesaid and other objectives are realized by providing an air conditioning charging hose assembly and method particularly for use on vehicle air conditioning systems. The preferred hose assembly is provided with a service port inlet coupler, a first hose section, a pressure gauge with charge markings on the face, a second hose section, a shut-off valve and a refrigerant supply fitting with a rotatable needle and knob for connection to a refrigerant gas canister. The hose assembly with the shut-off valve in a closed position is connected by the service port inlet coupler to a vehicle air conditioning system. A refrigerant gas canister is then threadably connected to the refrigerant supply fitting. The gas cannister may supply refrigerant gases, oil, dyes or other additives to the air conditioning system. The needle of the supply fitting is rotated by the knob to puncture the seal of a refrigerant gas canister whereby the shut-off valve can be opened to allow refrigerant gas to flow from the canister into the hose assembly and vehicle air conditioning system. A quick-turn shut-off valve is positioned at the end of the second hose section proximate the refrigerant supply fitting to allow the user to quickly discontinue the refrigerant gas flow into the vehicle air conditioner system as needed after the canister is punctured and before exhaustion. The quick-turn shut-off valve also allows the technician to remove or change the cannister without removing the hose assembly from the vehicle air conditioning system, thus preventing loss of refrigerant gases into the environment.

The method of use allows the hose assembly to remain connected to the vehicle air conditioner system while supplying refrigerants and/or testing the pressure of either the vehicle air conditioning system or the refrigerant gas canister since the quick-turn shut-off valve is positioned on the hose between the pressure gauge and the refrigerant supply fitting.

In another embodiment of the invention the refrigerant supply fitting includes a fixed needle which penetrates or punctures the refrigerant gas canister seal as the canister is threaded into the supply fitting.

In a further embodiment, the charging hose assembly does not include a pressure gauge for economy purposes.

DETAILED DESCRIPTION OF THE PREFERRED EMBODIMENT AND OPERATION OF THE INVENTION

Figure 1:
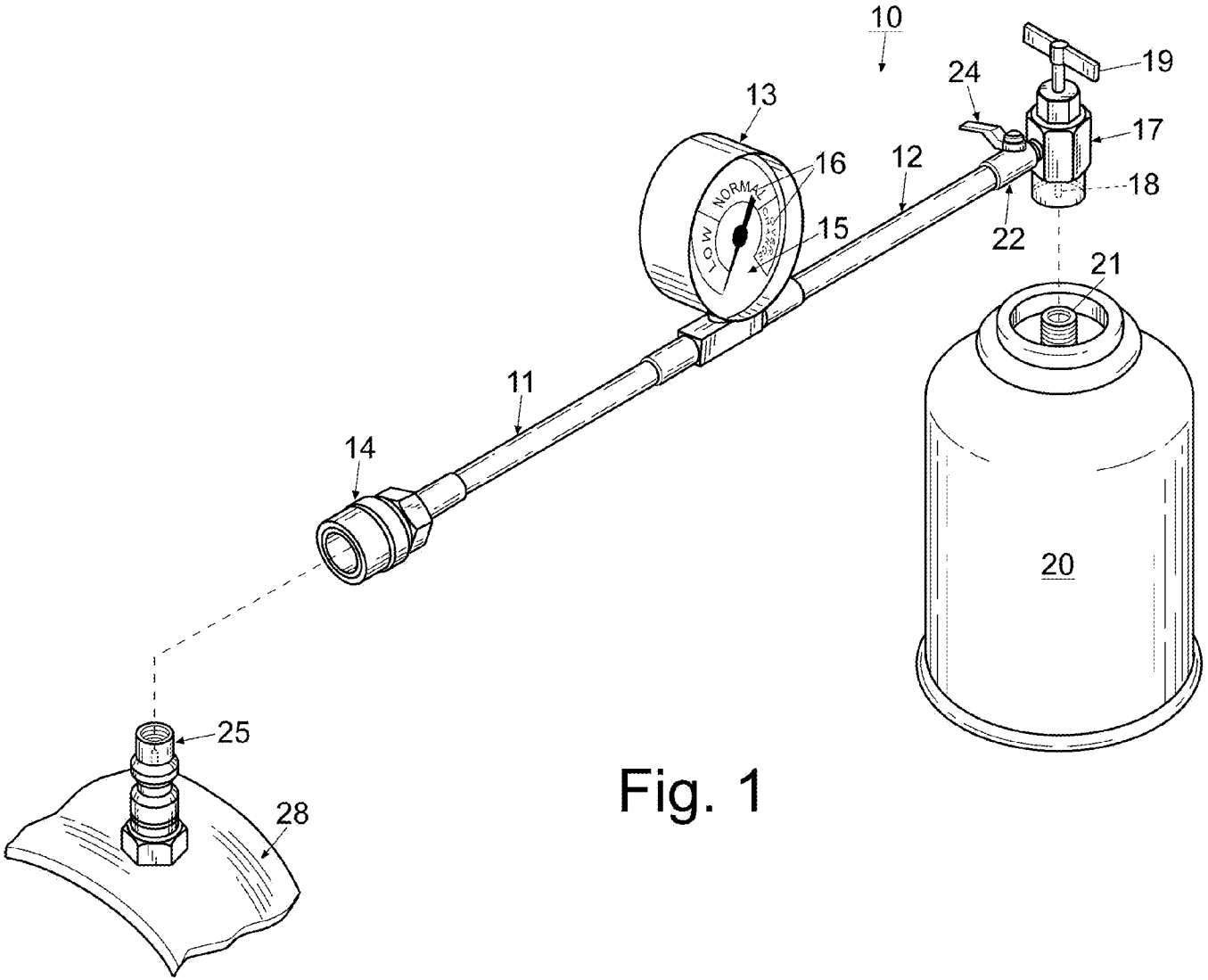
FIG. 1 demonstrates the preferred air conditioning charging assembly utilizing a rotatable knob and needle to rupture the refrigerant gas canister in use.

For a better understanding of the invention and its operation, turning now to the drawings, FIG. 1 shows preferred air conditioning charging hose assembly 10 having first flexible hose section 11 connected at one end to conventional service port inlet coupler 14 and standard pressure gauge 13 with a face 15 with charge (zone) markings 16 indicating a low charge (low pressure), a normal charge or overcharge connected to the other end. Charge markings 16 may be indicated by numbers, colors or both. Service port inlet coupler 14 is a conventional quick coupler which is normally closed but other embodiments such as a normally open service port coupler may be employed depending on the particular manufacturer and system to be serviced. Service port inlet coupler 14 engages standard inlet 25 of vehicle air conditioning system 28 (shown schematically) for fluid flow therebetween. Second flexible hose section 12 is connected at one end to pressure gauge 13 and shut-off valve 22 having finger lever 24 connected to the other end. Shut-off valve 22 is connected to and in fluid communication with refrigerant gas supply fitting 17 having knob 19 for threadably connecting to a standard refrigerant gas supply such as refrigerant gas canister 20 which may supply refrigerant gases, oil, dyes or other additives to air conditioning system 28.

Refrigerant supply fitting 17 includes internal threads for receiving threaded outlet 21 of refrigerant gas canister 20. Refrigerant supply fitting 17 includes a standard rotatable solid fitting needle 18 having knob 19 for rotating needle 18 to extend and thereby puncture the seal (not shown) of refrigerant gas canister 20 allowing the flow of refrigerant gas around solid needle 18 from canister 20 through hose assembly 10 into vehicle air conditioning system 28. Refrigerant gas cannister 20 has a threaded top with standard puncture type seal for use with supply fitting 17 which could be replaced with a supply fitting (not shown) for use with a "snap-on" cannister (not shown) having a usual mechanical or manual gas release valve such as used on spray paint cans.

Shut-off valve 22 positioned at the proximal end of second flexible hose section 12 is joined to and in communication with supply fitting 17. Second hose section 12 is likewise connected at its distal end to standard pressure gauge 13. Typical shut-off valve 22 includes finger lever 24 for quick and easy manual manipulation to start or stop the flow of refrigerant gas from canister 20. Shut-off valve 22 is a typical "quick-turn" shut-off valve in that finger lever 24 only rotates about ¼ turn from a fully open position to a fully closed position. Quick action shut-off valve 22 allows for rapid response and convenient control while supplying usual refrigerant gas such as R134a (not seen) from refrigerant gas canister 20 to inlet 25 of vehicle air conditioning system 28. Shut-off valve 22 allows a technician to remove canister 20 or change refrigerant gas canisters without removing hose assembly 10 from air conditioning system 28, thus preventing the harmful release of refrigerant gases into the atmosphere.

When service port inlet coupler 14 is removed from inlet 25, service port inlet coupler 14 closes which allows refrigerant gas canister 20 to be pressure tested with quick-turn shut-off valve 22 opened by reading markings 16 on face 15 of pressure gauge 13.

Quick-turn shut-off valve 22 is positioned for convenience and rapid operation and easy adjustment of refrigerant gas flow, thus allowing a technician to more precisely add the correct amount of refrigerant gas to charge air conditioning system 28. Further, servicing is faster and safer in that the refrigerant gas flow from refrigerant gas canister 20 can be cut-off quickly by finger lever 24 of shut-off valve 22, if necessary. In addition, quick-turn shut-off valve 22 allows hose assembly 10 to remain joined to refrigerant gas canister 20 after charging or testing is completed. Shut-off valve 22 further allows the technician to check the pressure of air conditioning system 28 while refrigerant gas canister 20 is connected and during the process of charging vehicle air conditioning system 28. When shut-off valve 22 is closed by lever 24, the pressure of vehicle air conditioning system 28 is tested and as necessary, shut-off valve 22 can be opened by lever 24 to finish charging air conditioning system 28 from refrigerant gas canister 20.

In the method of servicing a typical air conditioning system, such as vehicle air conditioning system 28, hose assembly 10 is connected to air conditioning system 28 by connecting service port inlet coupler 14 to inlet 25 with shut-off valve 22 closed by finger lever 24. With hose assembly 10 so connected, pressure gauge 13 is read to determine the pressure of refrigerant within vehicle air conditioning system 28. Next, if system 28 is low on refrigerant as determined by the test, a canister of conventional refrigerant gas such as canister 20 is then threadably joined to supply fitting 17 as shown in FIG. 1. Once refrigerant gas canister 20 is threaded thereon, knob 19 is rotated allowing fitting needle 18 to puncture and penetrate the seal (not shown) of refrigerant gas canister 20. Next, finger lever 24 of quick-turn shut-off valve 22 is rotated ¼ turn to the open position, allowing gas from refrigerant gas canister 20 to flow through second hose section 12, pressure gauge 13, first hose section 11, through service port inlet coupler 14 into inlet 25 and into vehicle air conditioning system 28 for charging. Once air conditioning system 28 has been sufficiently charged shut-off valve 22 is then closed to stop the flow of refrigerant gas and pressure gauge 13 is read to test the pressure of vehicle air conditioning system 28. Should the pressure be insufficient shut-off valve 22 is opened by lever 24 to again supply refrigerant gas from canister 20 to system 28. This step in the charging process is repeated until pressure gauge 13 supplies a desired reading from system 28 as determined by the technician. Once pressure gauge 13 reaches its required reading, shut-off valve 22 is closed and service port inlet coupler 14 is thereafter disconnected from inlet and automatically closes. The pressure of refrigerant gas remaining in canister 20 can then be tested by opening shut-off valve 22 and markings 16 of gauge 13 read and if empty canister 20 can be removed from supply fitting 17 and properly discarded. However, if refrigerant gas canister 20 is not empty and can be used again, shut-off valve 22 is closed to retain the refrigerant gas in canister 20 and hose assembly 10 can be stored with canister 20 still attached until another air conditioning system charging is needed.

Figure 2:
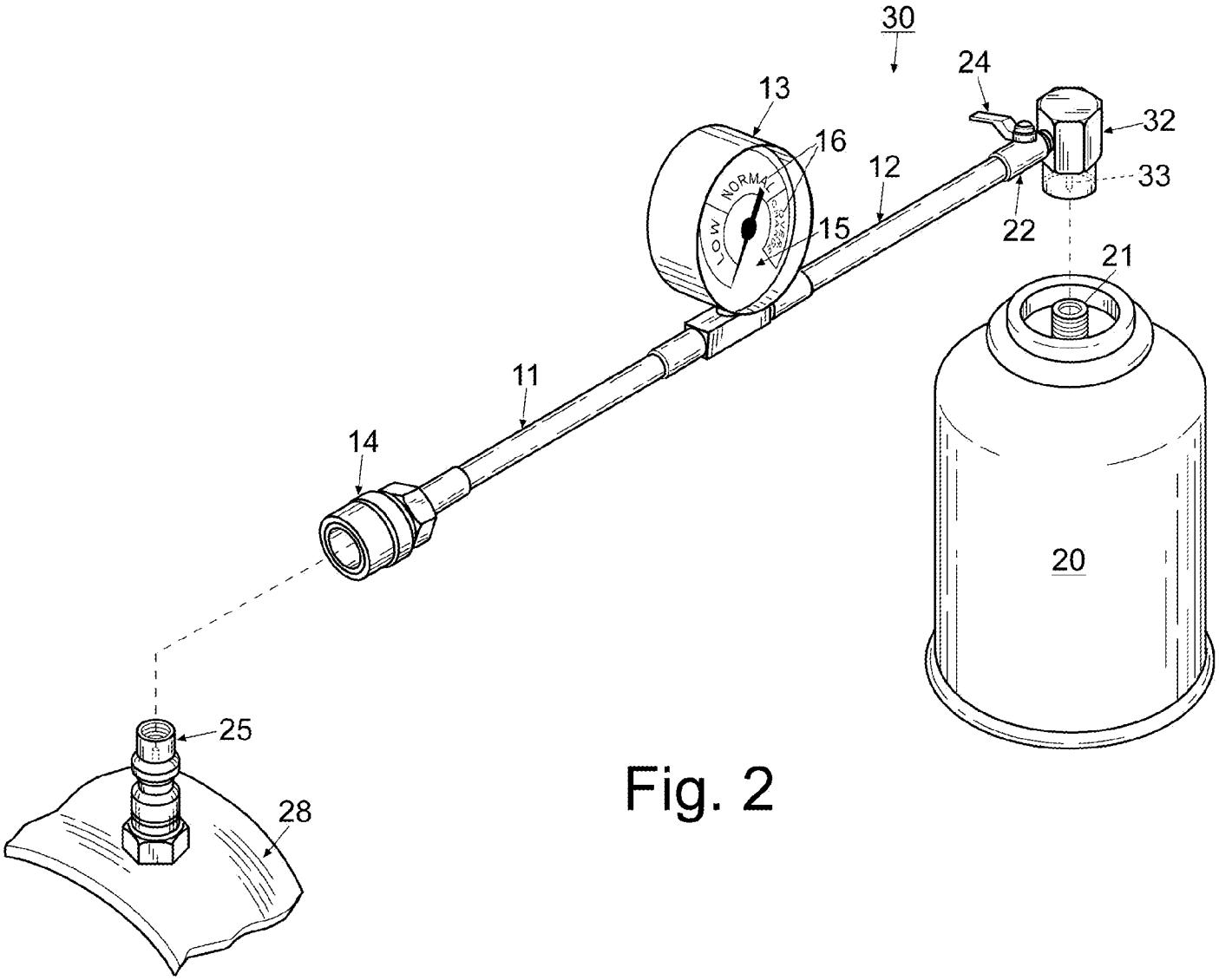
FIG. 2 illustrates an alternate embodiment of the hose assembly as shown in FIG. 1 having a fixed needle which threadably ruptures the refrigerant gas canister as the supply fitting is threaded onto the canister.

In FIG. 2, alternate charging hose assembly 30 is seen which is identical to charging hose assembly 10 except that supply fitting 32 includes fixed hollow needle 33 seen in dashed lines. Shut-off valve 22 with finger lever 24, hose sections 11 and 12, gauge 13 and service port inlet coupler 14 are all identical to those shown in preferred hose assembly 10 described above. As earlier explained, supply fitting 32 is threaded onto threaded outlet 21 of refrigerant gas canister 20 allowing fixed hollow needle 33 to rotate into and penetrate the seal (not seen) of canister 20, permitting refrigerant gas flow therethrough.

Figure 3:
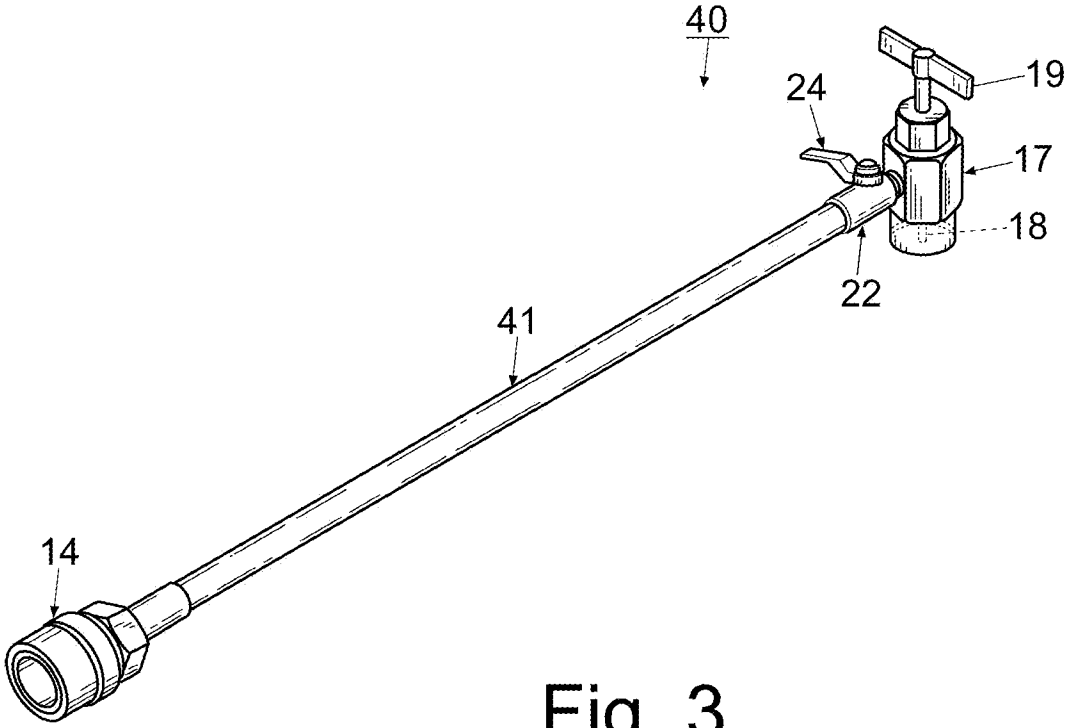
FIG. 3 shows another embodiment of the charging hose assembly without the pressure gauge.

A third embodiment of the charging hose assembly is seen in FIG. 3. Here no pressure gauge is provided on hose 41 of charging hose assembly 40. Shut-off valve 22 is available for use during the air conditioning system charging process. Hose assembly 40 is more economical to purchase but somewhat limits the technicians use and requires other equipment for air conditioning system pressure testing.

The illustrations and examples provided herein are for explanatory purposes and are not intended to limit the scope of the appended claims.

I claim:

1. A method of servicing an air conditioning system comprising the steps of:

a) providing an air conditioning charging hose assembly having a service port inlet coupler with a pair of opposing coupler openings oriented parallel to and in coaxial relationship with a fluid channel, a quick turn shut-off valve defining a pair of opposing valve openings oriented parallel to and in coaxial relationship with the fluid channel, a supply fitting defining a pair of fitting openings, one of the fitting openings more proximal to the service port inlet coupler and oriented parallel to and in coaxial relationship with the coupler openings, the other fitting opening more distal the service port inlet coupler and oriented perpendicular to the coupler openings and containing a needle therein, all joined to a fluid channel with a pressure gauge between the service port inlet coupler and the shut-off valve, whereby the supply fitting defines a separate body from, and is in directly abutting relationship with the shut-off valve;

b) closing the shut-off valve;

c) attaching the service port inlet coupler to the air conditioning system;

d) reading the pressure gauge to test the pressure of the air conditioning system at the service port inlet coupler; and e) limiting the release of refrigerant gases into the atmosphere and aiding in the precise addition of refrigerant into the air conditioning system with the supply fitting and shut-off valve.

2. The method of claim 1 wherein the step of providing an air conditioning charging hose assembly comprises the step of providing the air conditioning charging hose assembly having the needle of the supply fitting being a rotatable needle.

3. The method of claim 1 wherein the step of providing an air conditioning charging hose assembly comprises the step of providing the air conditioning charging hose assembly having the needle of the supply fitting being a fixed needle.

4. The method of claim 1 further comprising the step of attaching an air conditioning refrigerant gas canister to the supply fitting.

5. The method of claim 4 further comprising the step of opening the shut-off valve to allow refrigerant gas from the air conditioning refrigerant gas canister to flow through the air conditioning charging hose assembly to the air conditioning system.

6. The method of claim 5 further comprising the steps of:

a) closing the shut-off valve to stop the flow of refrigerant gas from the air conditioning refrigerant gas canister;

b) reading the pressure gauge to test the pressure of the air conditioning system at the service port inlet coupler;

c) removing the service port inlet coupler from the air conditioning system;

d) opening the shut-off valve to allow the flow of refrigerant gas from the air conditioning refrigerant gas canister; and e) reading the pressure gauge to determine the pressure of the refrigerant gas canister.

7. The method of claim 5 further comprising the steps of:

a) closing the shut-off valve to stop the flow of refrigerant gas from the air conditioning refrigerant gas canister;

b) reading the pressure gauge to test the pressure of the air conditioning system at the service port inlet coupler;

c) opening the shut-off valve to allow the flow of refrigerant gas from the air conditioning refrigerant gas canister to flow through the air conditioning charging hose assembly to the air conditioning system;

d) closing the shut-off valve to stop the flow of refrigerant gas from the air conditioning refrigerant gas canister;

e) reading the pressure gauge to test the pressure of the air conditioning system at the service port inlet coupler; and f) removing the service port inlet coupler from the air conditioning system.

8. An air conditioning charging hose assembly comprising: a service port inlet coupler, a hose, said service port inlet coupler attached to one end of said hose and defining a pair of opposing coupler openings oriented parallel to and in coaxial relationship with said hose, a quick-turn shut-off valve, said shut-off valve attached at the opposite end of said hose and defining a pair of opposing valve openings oriented parallel to and in coaxial relationship with the hose, and a refrigerant supply fitting defining a pair of fitting openings, one of the fitting openings more proximal to the service port inlet coupler and oriented parallel to and in coaxial relationship with the coupler openings, the other fitting opening more distal the service port inlet coupler and oriented perpendicular to the coupler openings and containing a needle therein, said refrigerant supply fitting defining a separate body from said shut-off valve and in direct abutting relationship therewith, whereby said refrigerant supply fitting and said shut-off valve limit the release of refrigerant gases into the atmosphere and aid in the precise addition of refrigerant into an air conditioning system.

9. The assembly of claim 8 wherein said needle is rotatable.

10. The assembly of claim 8 wherein said needle is fixed.

11. The assembly of claim 8 wherein said quick-turn shut-off valve comprises a quarter turn shut-off valve.

12. The assembly of claim 8 wherein said service port inlet coupler is normally closed.

13. The assembly of claim 8 wherein said service port inlet coupler is normally open.

14. A method of servicing an air conditioning system comprising the steps of:

a) providing an air conditioning charging hose assembly having a service port inlet coupler attached at one end of a hose, the service port inlet coupler defining a pair of opposing coupler openings oriented parallel to and in coaxial relationship with said hose, a quick-turn shut-off valve attached at the opposite end of said hose and defining a pair of opposing valve openings oriented parallel to and in coaxial relationship with the hose, and a refrigerant supply fitting defining a pair of fitting openings, one of the fitting openings more proximal to the service port inlet coupler and oriented parallel to and in coaxial relationship with the coupler openings, the other fitting opening more distal the service port inlet coupler and oriented perpendicular to the coupler openings and containing a needle therein, whereby the shut-off valve and the supply fitting define separate bodies oriented in direct abutting relationship;

b) closing the shut-off valve;

c) attaching the service port inlet coupler to an air conditioning system;

d) attaching a refrigerant gas canister to the refrigerant supply fitting;

e) opening the shut-off valve to charge the air conditioning system; and f) limiting the release of refrigerant gases into the atmosphere and aiding in the precise addition of refrigerant into the air conditioning system with the supply fitting and shut-off valve combination.

15. The method of claim 14 wherein the step of providing an air conditioning charging hose assembly comprises the step of providing the air conditioning charging hose assembly having a pressure gauge positioned on the hose between the service port inlet coupler and the shut-off valve.

16. The method of claim 15 further comprising the step of closing the shut-off valve to test the pressure of the air conditioning system by reading the pressure gauge.

17. An air conditioning charging hose assembly comprising:

a service port inlet coupler affixed to an end of a fluid channel with a pair of opposing coupler openings oriented parallel to and in coaxial relationship with the fluid channel, a refrigerant supply fitting directly abutting a quick turn shut-off valve and affixed to an opposing end of the fluid channel, the shut-off valve defining a pair of opposing valve openings oriented parallel to and in coaxial relationship with the fluid channel, the supply fitting defining a pair of fitting openings, one of the fitting openings more proximal to the service port inlet coupler and oriented parallel to and in coaxial relationship with the coupler openings, the other fitting opening more distal the service port inlet coupler and oriented perpendicular to the coupler openings and containing a needle therein, and a pressure gauge defining a plurality of charge markings positioned in communication with the fluid channel between the service port inlet coupler and the shut-off valve, whereby the refrigerant supply fitting and the shut-off valve define separate bodies in abutting relationship to limit release of refrigerant into the atmosphere and aid in the precise addition of refrigerant into the air conditioning system.

18. The assembly of claim 17 wherein said quick-turn shut-off valve comprises a quarter turn shut-off valve.

19. The assembly of claim 17 wherein said service port inlet coupler is normally closed.

20. The assembly of claim 17 wherein said service port inlet coupler is normally open.

21. The assembly of claim 17 wherein said needle is rotatable.

22. The assembly of claim 17 wherein said needle is fixed.

* * * * *